US005683279A

United States Patent [19]

Raasch et al.

[11] Patent Number: 5,683,279

[45] Date of Patent: Nov. 4, 1997

[54] MULTI-PART DIVING FIN

[75] Inventors: Jason J. Raasch, Wheeling, Ill.; Mark Faulconer; Tim Bowman, both of Newport Beach, Calif.

[73] Assignee: Dacor Corporation, Northfield, Ill.

[21] Appl. No.: 559,247

[22] Filed: Nov. 16, 1995

[51] Int. Cl.[6] ..... A63B 31/10

[52] U.S. Cl. ..... 441/64

[58] Field of Search ..... 441/61–64, 70; D21/239

[56] References Cited

U.S. PATENT DOCUMENTS

| | | | |
|---|---|---|---|
| 3,302,222 | 2/1967 | Ferraro | 441/64 |
| 3,411,165 | 11/1968 | Murdoch | 441/64 |
| 3,922,741 | 12/1975 | Semeia | 441/64 |
| 4,820,218 | 4/1989 | Van de Pol | 441/64 |
| 4,869,697 | 9/1989 | Ackert et al. | 441/70 |
| 5,093,162 | 3/1992 | Fenton et al. | 428/34.5 |
| 5,108,327 | 4/1992 | Klein | 441/64 |
| 5,417,599 | 5/1995 | Evans | 441/64 |
| 5,435,764 | 7/1995 | Testa et al. | 441/64 |

FOREIGN PATENT DOCUMENTS

| | | | |
|---|---|---|---|
| 0310828 | 4/1989 | European Pat. Off. | 441/64 |
| 2705245 | 11/1994 | France | 441/64 |

*Primary Examiner*—Edwin L. Swinehart

*Attorney, Agent, or Firm*—Greer, Burns & Crain, Ltd.

[57] ABSTRACT

A multi-part diving fin includes a blade portion having a tip and a shoe end opposite the tip, the shoe end at least partially defining a foot pocket, and a foot plate formed as a separate piece from the blade portion and having a formation for releasably engaging the blade portion, the foot plate configured so that upon engagement with the blade portion, the foot plate provides a bottom of the foot pocket. The present fin also features a vertical adjustment of the height of the foot pocket, as well as stiffness adjustment for the blade portion of the fin.

30 Claims, 6 Drawing Sheets

MULTI-PART DIVING FIN

BACKGROUND OF THE INVENTION

The present invention relates to diving fins used for swimming, snorkeling and scuba diving, and more specifically to such a fin designed for use with diving boots or shoes, and having a two-piece construction. One piece is the blade portion, and the other is a separate foot plate.

Conventional diving fins include a relatively rigid blade portion, typically made of injection molded plastic, and a relatively soft foot pocket, made of rubber, silicone, or some other flexible rubber-like material. The blade portion must be rigid to perform its water propulsion function, and the foot pocket must be flexible to be easy to put on and take off by the diver, as well as being comfortable during use. Certain conventional fins are intended for use with bare feet, and in such cases, the foot pocket completely encloses the foot, and is soft and flexible for diver comfort. That type of fin is not at issue here.

In contrast, there are conventional fins which are designed for use with dive boots or shoes, and as such have a foot pocket which is open at the rear, and which has a heel strap connected to each side of the fin. These latter foot pockets are typically more rigid than the completely enclosed "barefoot" style of foot pocket. This added rigidity is due in part to the need of more serious divers for fins which can withstand powerful kicking strokes to propel them long distances underwater. The relatively rigid open foot pockets are better at transmitting this kicking force to the fins.

Even in the open style of foot pocket, the foot pocket is typically integrally formed with the blade portion. Due to the disparate materials used for the foot pocket and the blade portion, relatively sophisticated production techniques are required to provide functional, as well as commercially viable products. Such production techniques include insert molding, compression molding, ultrasonic welding and special adhesives. These complicated manufacturing techniques add a significant cost factor to diving fins, and hinder the manufacturer's ability to experiment with new fin designs, or to offer wide ranges of fin configurations.

In addition, conventional fin production techniques restrict the types of materials available for fin construction to those which are compatible with the relatively soft rubber or rubber-like foot pocket material. For example, most currently available fins are manufactured of ethylvinylacetate (EVA), thermoplastic elastomers (TPE), thermoplastic rubbers (TPR) or polyurethane. One of the drawbacks of these materials, and particularly referring to EVA, is that the material is non-stick, and as such is inherently difficult to apply graphics or art work to products made of this material. Thus, conventional fins are only decorated to the extent that pigments may be molded into the blade material, and/or may have hot-stamped designs or logos. However, the latter do not remain permanently affixed to the blade.

Another design criteria of diving fins is that many divers now wear diving boots. In some cases, these boots may be capable of use as beach or walking shoes, and have an appearance more like "terrestrial" sports shoes used for walking or running. It has previously been difficult for divers to readily wear such shoes with typical diving fins. Often, significant and cumbersome adjustments must be made to the foot pocket to permit the use of such shoes. It is also awkward for divers to easily remove conventional fins, even when they are worn without diving boots. Diving boots may in some applications have a tendency to increase the difficulty of putting on and/or taking off diving fins.

Still another design criterion of diving fins is the relative stiffness of the blade portion. Depending on the experience and strength of the diver, and the type of diving done, different stiffness characteristics are preferable. However, due to the relatively high cost of producing fins, there has not yet been a significant amount of research performed on fin stiffness characteristics.

Yet another design criterion of conventional diving fins is that certain types or sizes of diving boots may, depending on their configuration, be more difficult to insert and/or withdraw from fin foot pockets.

Thus, there is a need for a diving fin which is inexpensive to manufacture and which is free of the requirement for integrally combining disparate materials. There is also a need for a diving fin which is adaptable for use with diving boots. In addition, there is a need for a fin which may be manufactured in a variety of blade stiffnesses and configurations.

Accordingly, it is an object of the present invention to provide an improved diving fin made of two separate, relatively rigid components.

It is another object of the present invention to provide an improved diving fin which is compatible with shoe-like diving boots of various sizes and configurations.

It is a further object of the present invention to provide an improved diving fin which allows the fin designer to inexpensively provide a wide range of blade stiffnesses and configurations, and using a wider variety of materials than currently available to fin designers.

It is a still further object of the present invention to provide an improved diving fin which can be substantially covered with a bonded graphics treatment.

It is yet another object of the present invention to provide an improved diving fin which includes separate skegs for altering the performance of the fin.

SUMMARY OF THE INVENTION

The above-identified objects are met or exceeded by the present multi-part diving fin, which features a separate foot plate which is engageable with a main blade portion. In the preferred embodiment, the foot plate provides a bottom for the foot pocket of the fin. Another feature of the present fin is a vertical adjustment of the height of the foot pocket, as well as a stiffness adjustment for the blade portion of the fin. The latter feature allows the diver to select the stiffness which is most appropriate for his ability and/or local diving conditions.

More specifically, a multi-part diving fin includes a blade portion having a tip and a shoe end opposite the tip, the shoe end at least partially defining a foot pocket, and a foot plate formed as a separate piece from the blade portion and having a formation for engaging the blade portion, the foot plate configured so that upon engagement with the portion, the foot plate provides a bottom of the foot pocket.

In another embodiment, the present invention provides a swimming fin including a blade portion and a separate foot plate, the blade portion having a longitudinal axis, two side edges and a knobbed stub shaft projecting from each side generally normally to the axis. A bracket projects from at least one side of the foot plate and has at least two vertically spaced openings, the openings being constructed and arranged on the foot plate so that vertical adjustment of the foot plate relative to the blade portion is achieved by insertion of the stub shaft into a corresponding one of the openings.

In a still further embodiment, a stiffness segment is provided for use in a diving fin having a blade portion with a tip and a shoe end opposite the tip, the blade portion having a longitudinal axis and a foot plate separate from the blade portion. The stiffness adjustment includes at least one stiffness rod located on the foot plate so as to engage a corresponding tube on the blade portion. The stiffness of the blade portion increases with the distance of penetration of the at least one rod in the tube.

In still another embodiment, a diving fin is provided having a blade portion with a top surface and an underside, whereby between approximately 10 to 100% of at least one of the top surface and the underside is provided with a bonded graphics treatment. As additional features, the present fin may be provided with separate detachable skegs or flow vanes, as well as separate stiffness inserts for adjusting the performance characteristics of the fin to suit a particular diver's abilities or preferences, or to adapt to particular diving situations.

DESCRIPTION OF THE PREFERRED EMBODIMENT

Figures 1, 2:
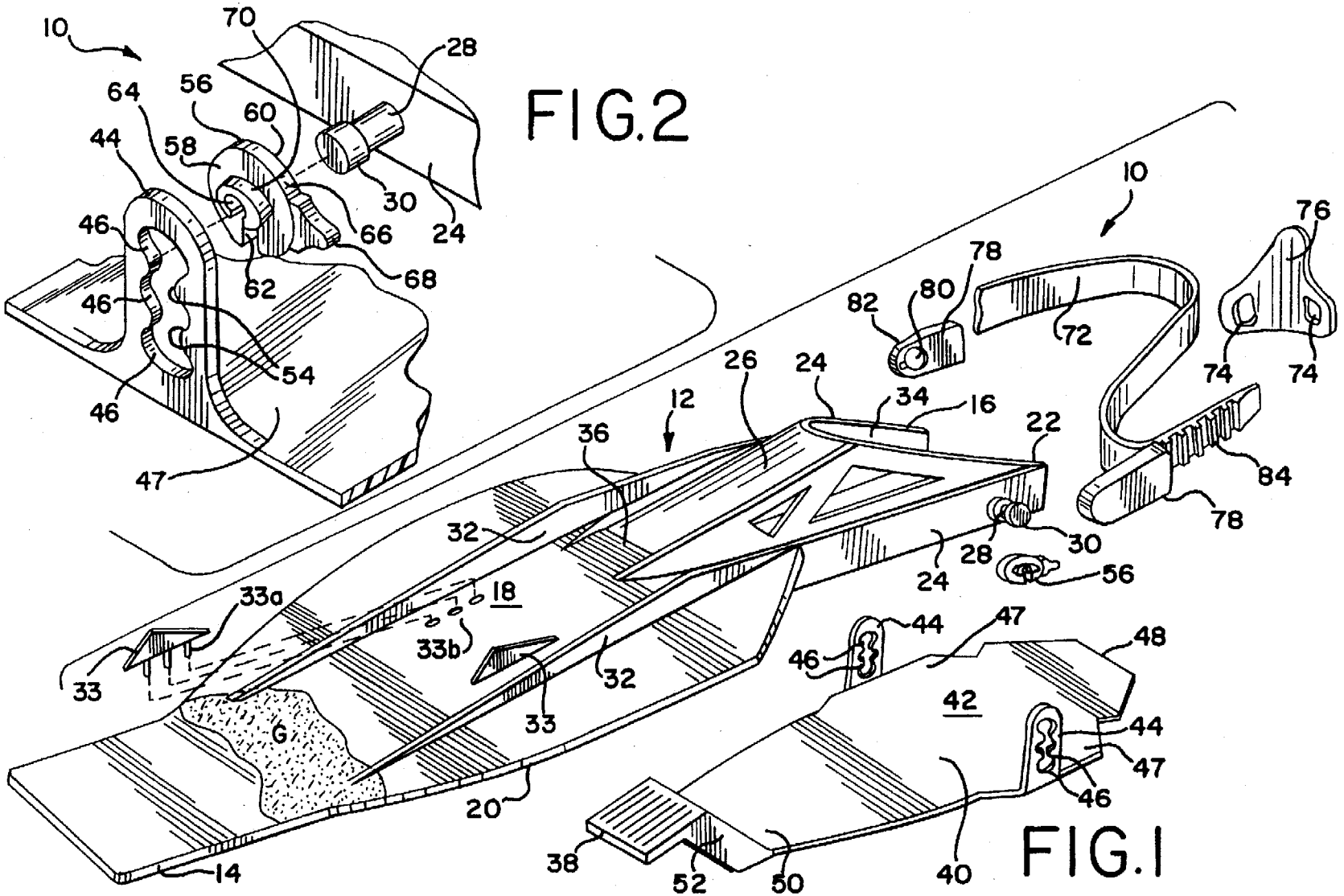
FIG. 1 is an exploded top perspective elevation of a diving fin incorporating the features of the present invention.
FIG. 2 is a fragmentary exploded perspective elevation of a foot plate height adjustment for use with the present invention.

Referring now to FIG. 1, the diving fin of the invention is generally designated 10 and includes a generally flat, planar blade portion 12 having a tip 14 at one end, a shoe end 16 opposite the tip, a top surface 18 and an underside 20. The blade portion 12 is preferably made of a self supporting, durable and enviromnentally resistant plastic material, and is preferably manufactured as a single piece as by injection molding or other known technologies. However, it is also contemplated that the blade portion 12 be assembled from more than one separate component piece.

As is evident in FIG. 1, the shoe end 16 partially defines a foot pocket 22, and includes a pair of sides 24 and an arch portion 26 joining upper edges of the sides 24. Laterally projecting from each side 24 is a heel strap mounting stub shaft 28, having an enlarged or knobbed end 30.

In the preferred embodiment, a pair of vertically projecting support ribs 32 are integrally formed in the blade portion 12. However, it is contemplated that the number and shape of such ribs may vary with a particular type of fin having certain desired characteristics, or may be totally absent, depending on the desired performance of the fin.

It is also contemplated that separately manufactured ribs or skegs 33 may be secured as desired to at least one of the top surface 18 or the underside 20. The skegs 33 may be secured by adhesives, ultrasonic welding, threaded fasteners, rivets or other known fastening technologies, or may be provided with depending lugs **33*a* for engaging corresponding openings 33*b* in the blade portion 12**.

A rear end 34 of the foot pocket 22 defines a generally U-shaped entry opening for the diver's foot. Opposite the rear end 34, the foot pocket includes a transverse slot 36, which accommodates a front end tab 38 of a foot plate 40.

One feature of the present fin 10 is that the generally planar foot plate 40 is formed as a separate piece from the blade portion 12. This arrangement provides for an adjustability by which a single fin may accommodate a wider range of shoe sizes than conventional fins, and allows the fin 10 to be constructed more economically.

Another of the features of the present invention is that since the blade portion 12, and the foot plate 40 are made of separate pieces, unlike conventional fins, the blade portion and/or the foot plate do not have to be compatible with rubber or rubber-like materials, and may be made of a material selected from a far wider range of materials than previously available. It is preferred that the present blade portion and/or foot plate be made of a material having one or more of the following characteristics: a specific gravity of at least 1.0, a 24 hour water absorption in the approximate range of 0.15 to 3.5 $in^3/lb$, a flexural modulus in the approximate range of 100 to 500 (in units of $10^3$ p.s.i. @73° F.), and a tensile yield in the approximate range of 1,000 to 15,000 (in units of $10^3$ p.s.i.). Such materials are preferably synthetic plastics or composite blends, and one such material is PETG having a specific gravity of 1.27, a flexural modulus of 309 ($10^3$ p.s.i @73° F.) and a tensile yield of 6990 ($10^3$ p.s.i.).

This freedom in the selection of fin materials means that the fin 10 may be decorated with one or more of a so-called bonded graphics treatment G (best seen in FIG. 1), which was previously unavailable to fin builders. By bonded graphics treatment means that the graphics treatment is securely and preferably permanently formed onto or into the blade portion and/or the foot plate. These bonded graphics treatments include, but are not limited to sublimation, printing, etching and painting. In the preferred embodiment, the fin 10 has as much as approximately 10 to 100% of the blade portion 12 provided with a bonded graphics treatment.

Included on the foot plate 40 is a sole portion 42 dimensioned to be placed below the shoe end 16 to form the bottom of the foot pocket 22. At each side of the sole portion 42 is located a generally vertically projecting bracket 44, which in this embodiment is a cam follower bracket, each of which defines at least two and preferably three vertically spaced openings 46 for engaging a corresponding stub shaft 28. The brackets 44 are located on relatively wider portions 47 of the sole portion 42, so that the brackets 44 will engage the stub shafts 28. A rear or second end 48 of the foot plate 40 is disposed to accommodate the heel of the diver's shoe, and the front end tab 38 is located at a front or first end 50.

The front end tab 38 is constructed and arranged to slidingly and pivotally engage the transverse slot 36. As such, the engagement of the tab 38 in the slot acts as a forward attachment point for the foot plate 40 and also allows the foot plate to pivot to accommodate various sizes of divers' shoes. More specifically, the foot plate 40 is pivotable in a vertical plane parallel to the longitudinal axis of the blade portion 12, with the tab 38 defining the pivot point. In structure, the tab 38 is generally parallel to the sole portion 42, and is held in elevated relation thereto by a pair of gussets 52, which are integral with both the tab 38 and the sole portion 42.

Figure 3:
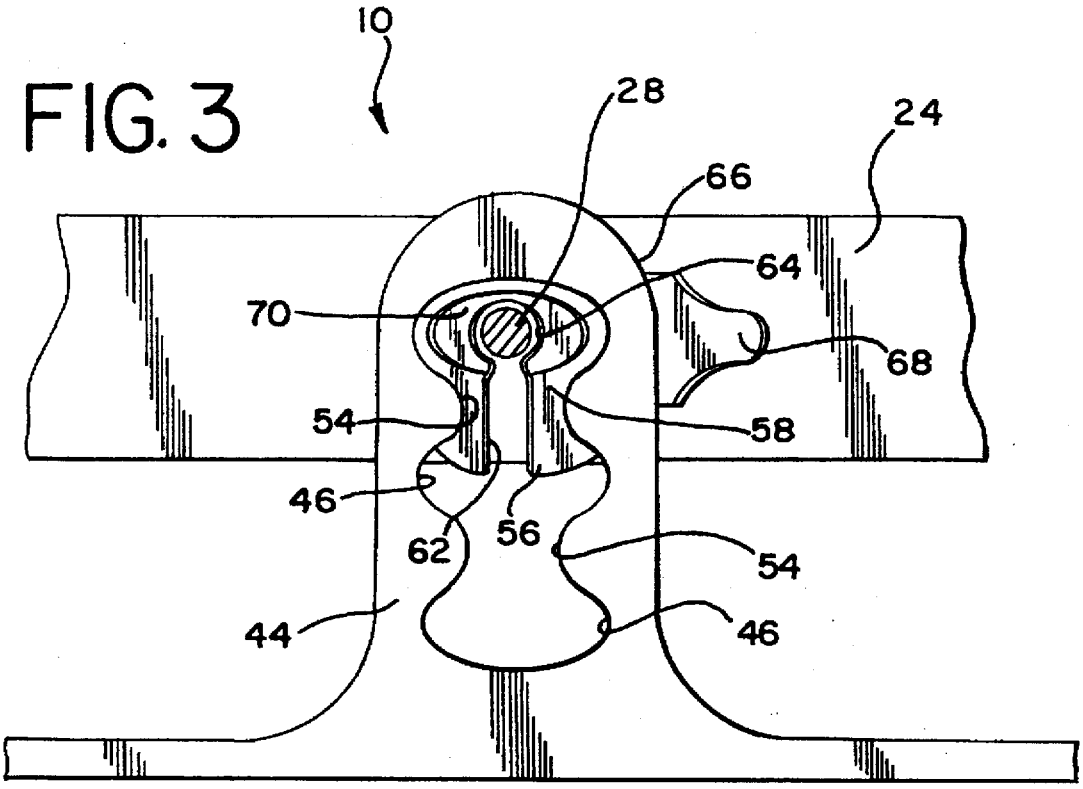
FIG. 3 is a fragmentary side elevational view of the height adjustment device shown in FIG. 2 in a locked position.
Figure 4:
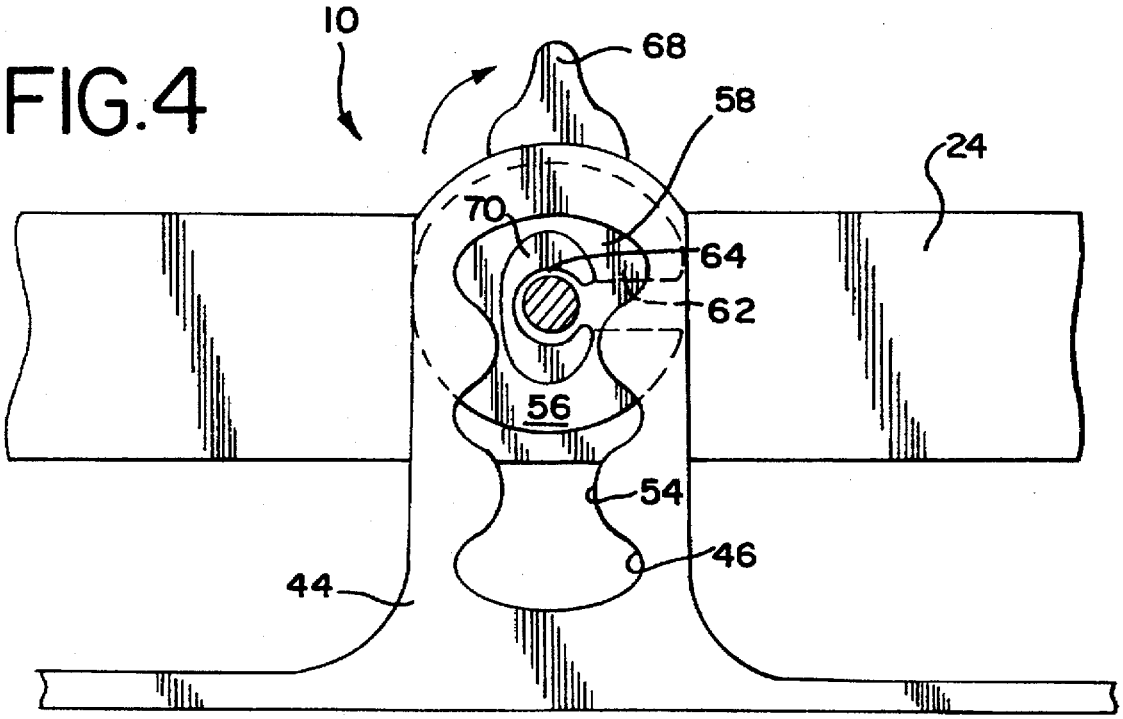
FIG. 4 is a fragmentary side elevational view of the height adjustment device shown in FIG. 2 in a transitional position.

Referring now to FIGS. 2–4, an adjustability feature of the foot plate 40 relative to the shoe end 16 will be described in greater detail. In the preferred embodiment, each bracket 44 is provided with three elliptical openings 46 which are vertically spaced relative to each other, and are in communication with each other. The openings 46 are separated from each other by relatively laterally narrower open channels 54. It is contemplated that the number and configuration of the openings 46 and channels 54 may be varied to suit a particular application.

Between each of the brackets 44 and the sides 24 is located an adjustor disc 56 being generally circular in shape, with a first or outside 58 corresponding to the bracket 44, and a second or inside 60 corresponding to the side 24. A slot 62 is in communication with a central opening 64 to permit the disc 56 to be pushed onto the corresponding shaft 28. In the preferred embodiment, a peripheral edge 66 of the disc 56 is provided with a finger tab 68 to facilitate the divers' rotational manipulation of the disc about the shaft 28.

A cam formation 70 projects generally axially from the outside 58, and is dimensioned to be engageably received in one of the openings 46 in the corresponding bracket 44 at a given time. The cam formation 70 is generally elliptical in shape, with a length longer than its height. This first position of the cam formation 70 is also referred to as a locked position, and is best seen in FIG. 3. Vertical adjustment of the foot plate 40 relative to the blade portion 12 and the shoe end 16 is achieved on each side 24 by rotation of the cam formation 70 about the corresponding shaft 28.

Referring now to FIG. 4, the disc 56 is rotated so that the cam formation 70 is placed in a second or transitional position which enables the cam to slide in the channel 54 to a second vertically displaced one of the openings 46. Once located in the proper opening 46, each disc 56 is then rotated to return to the first position (best seen in FIG. 3) to lock the cam formation 70 in the second opening 46. This procedure is repeated on each side 24 so that the foot plate 40 is equally adjusted.

Referring again to FIG. 1, a heel strap 72 is threaded through openings 74 in a heel pad 76, as is common in such fins. A buckle 78 is located adjacent each strap end, and each buckle 78 is provided with a closed bore 80 which frictionally engages the knobbed end 30 of the corresponding stub shaft 28. A smaller portion 82 of the bore 80 is optionally provided for engaging the narrower diameter of the stub shaft 28 upon rearward tension being exerted on the strap 72. The heel strap 72 is thus secured to the fin 10 during diving. It is preferred that each buckle 78 is configured to adjust the length of the strap 72, as is well known in the art. To that end, the strap is provided with spaced vertical ribs 84 for engagement by a spring-biased latch pawl (not shown), or other known device for adjusting strap length.

Figure 5:
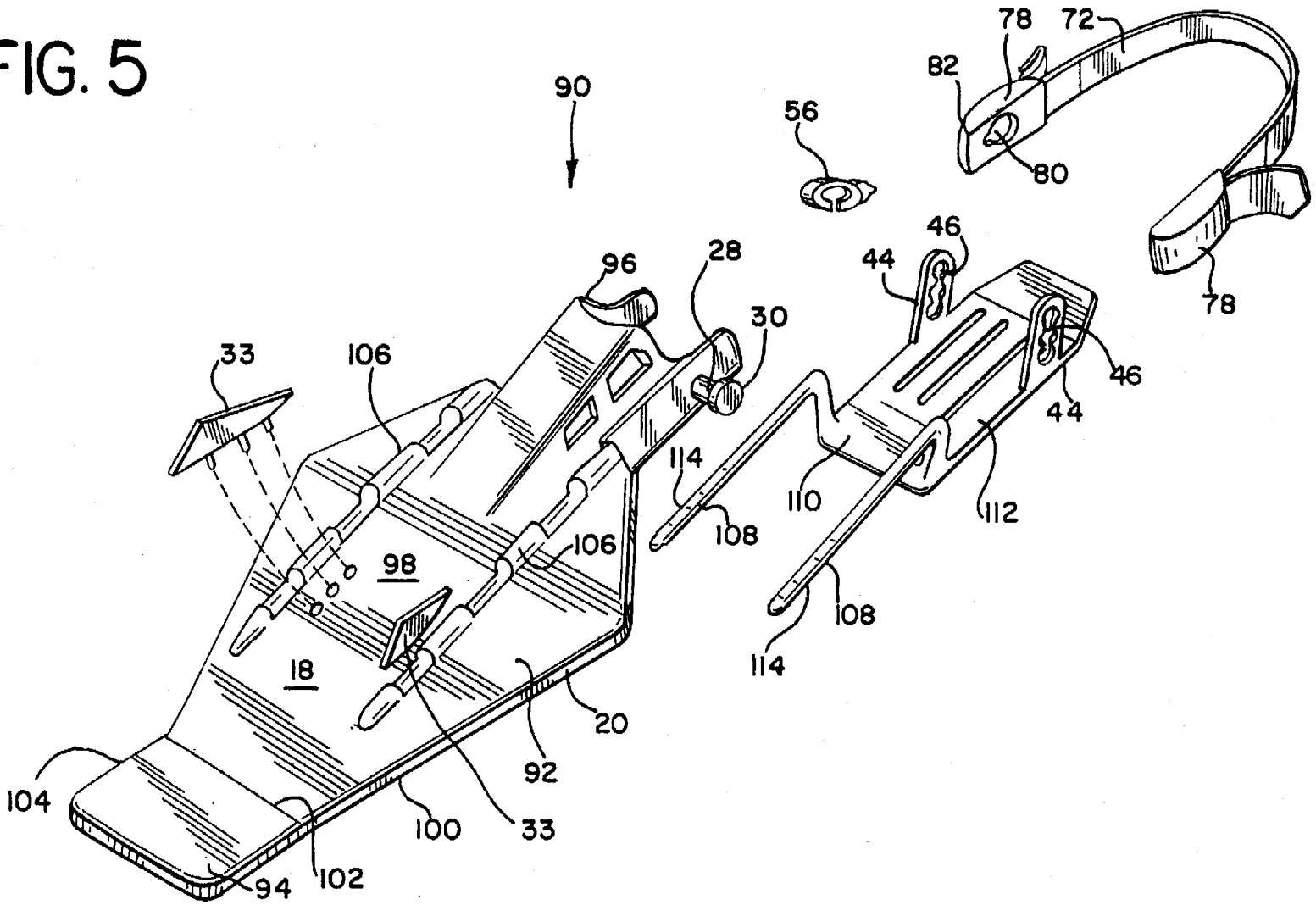
FIG. 5 is an exploded perspective elevational view of a fin incorporating an alternate embodiment of the present invention.

Referring now to FIG. 5, an alternate embodiment of the present fin is generally designated 90. Similar to the fin 10, the fin 90 basically has the some of the same features, which will be designated by the same reference numerals, and only the distinctive features will be described. The fin 90 includes a generally flat, planar blade portion 92 having a tip 94 at one end, a shoe end 96 opposite the tip, a top surface 98 and an underside 100. One distinctive feature of the blade portion 92 is that the tip 94 has at least one score line 102 which defines a detachable end segment 104. Thus, in cases where a diver desires a shorter blade which displaces less water and is easier for the diver to move through the water, the end segment 104 would be detached along the line 102 with a suitable cutting tool. It is also contemplated that additional linearly arranged segments 104 may be provided, each separated by a corresponding score line 102, and that the size of the segment may vary with the application.

Another distinctive feature of the blade portion 92 is that its support ribs 106 are hollow and open at the rear to accommodate stiffener rods 108 located at a forward end 110 of the foot plate 112. In the preferred embodiment, the stiffener rods 108 are generally cylindrical in cross-section, generally "L"-shaped, and further are integrally formed with the foot plate 112. However, other configurations of rods 108 and types of attachments are contemplated.

In the fin 90, the engagement of the stiffener rods 108 in the ribs 106 provides the frontal attachment points of the foot plate 112 to the blade portion 92, with the rear attachment of the foot plate 112 being accomplished by the brackets 44 and the knobbed stub shaft 28 as described previously. Since the foot plate 112 is formed as a separate component, the rods 108 also perform the pivot function of the tab 38 and transverse slot 36 of the fin 10.

Another function of the stiffener rods 108 is that they provide a mechanism for further controlling the stiffness of the blade portion 92. This is because the longer are the rods 108, the deeper they will penetrate the hollow ribs 106. Again, depending on the particular performance characteristics desired by the diver, the stiffness of the fin may be adjusted by shortening the rods 108, thus reducing the penetration distance, and making the blade portion 92 more flexible. It is preferred that the rods 108 be provided with score lines 114 to define the rods into segments for more accurate stiffening adjustment by the diver.

Figure 6:
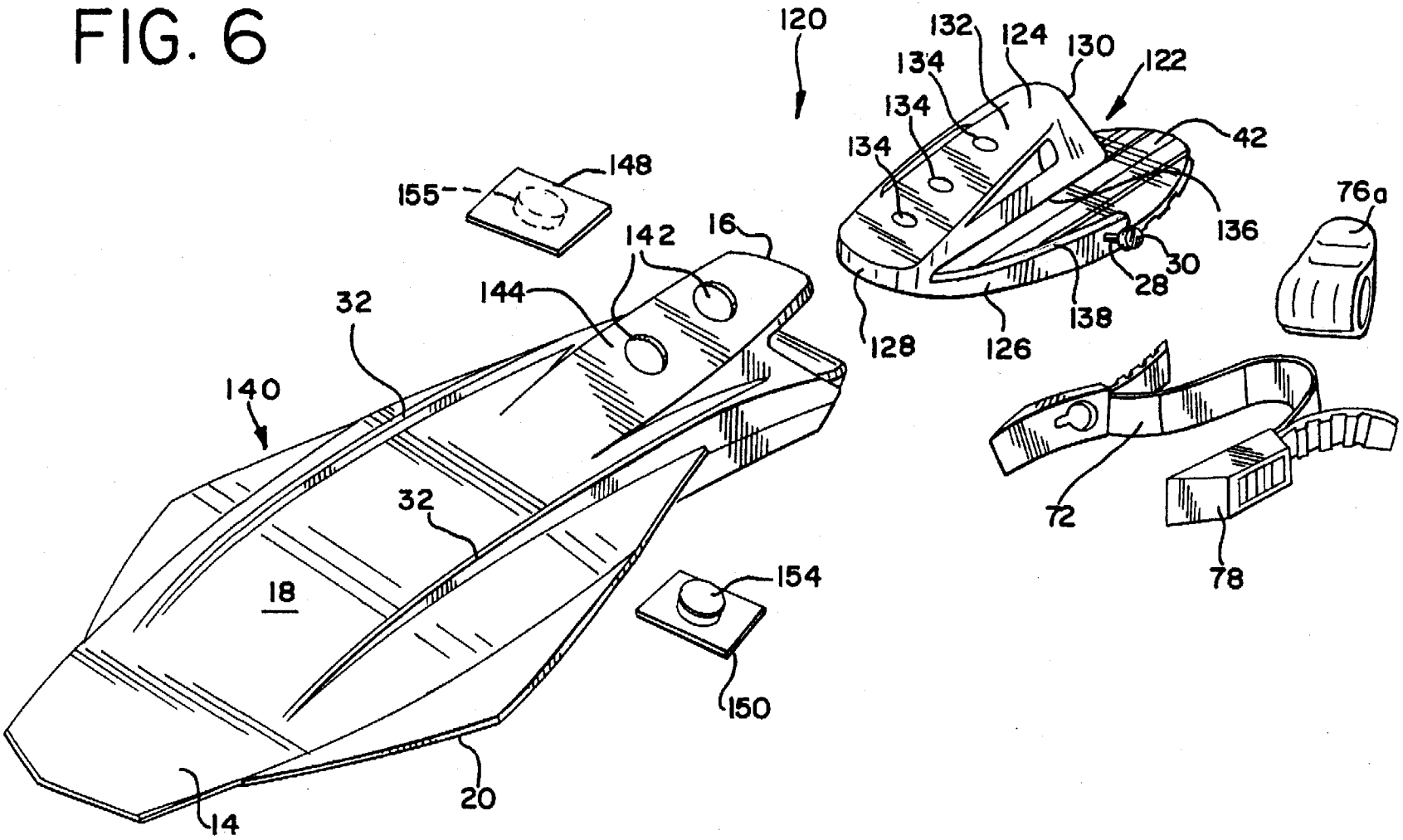
FIG. 6 is an exploded view of a fin incorporating a second alternate embodiment of the present invention.

Referring now to FIG. 6, still another embodiment of the present fin is generally designated 120. The fin 120 incorporates many common features of the fins 10 and 90, which will be designated with identical reference numerals. A significant feature of the fin 120 is that the foot plate 122 is formed as a clamshell having hinged upper and lower portions 124, 126. An integral front hinge portion 128 joins the two portions. The upper and lower portions 124, 126 together define the foot pocket 130.

An instep portion 132 of the upper portion 124 is provided with at least two and preferably three mounting apertures 134. Also, the upper portion includes a pair of side edges 136 which oppose respective edges 138 on the lower portion. The lower portion 126 also defines a sole portion 42, and includes the knobbed stub shafts 28.

The foot plate 122 is dimensioned to matingly engage the shoe end 16 of a blade portion 140. At least one and preferably two attachment openings 142 are defined by an upwardly inclined portion 144 of the shoe end 16. An opening 146 at the rear of the shoe end is dimensioned to matingly accommodate the foot plate 122.

Attachment of the foot plate 122 to the blade portion 140 is accomplished by insertion of the foot pocket into the opening 146 until the openings 134 are in alignment with the openings 142 in a manner which provides the desired length and height of the foot plate 122. As the foot plate 122 is inserted deeper into the shoe end 16, the edges 136 and 138 will come closer together, shortening the foot pocket to size it for a smaller shoe. Once the openings 134, 142 are properly aligned, they are releasably attached using a two part snap fastener, 148, 150.

A depending female snap formation 152 (shown hidden) integrally attached to the upper snap portion 148, matingly engages a vertically projecting boss 154 on the lower snap portion 150 through each corresponding pair of aligned openings 134, 142. The lower snap portion is placed in position inside the foot plate 122 by the user. Once the fastener portions are properly aligned, the user presses the upper and lower portions 148, 150 together to obtain a tight friction fit. The fin 120 also includes a heel strap 72 with a pair of buckles 78 and a heel pad 76*a*. Due to the vertical adjustability of the foot plate 122, the fin 120 does not require the adjustor discs 56.

Figure 7:
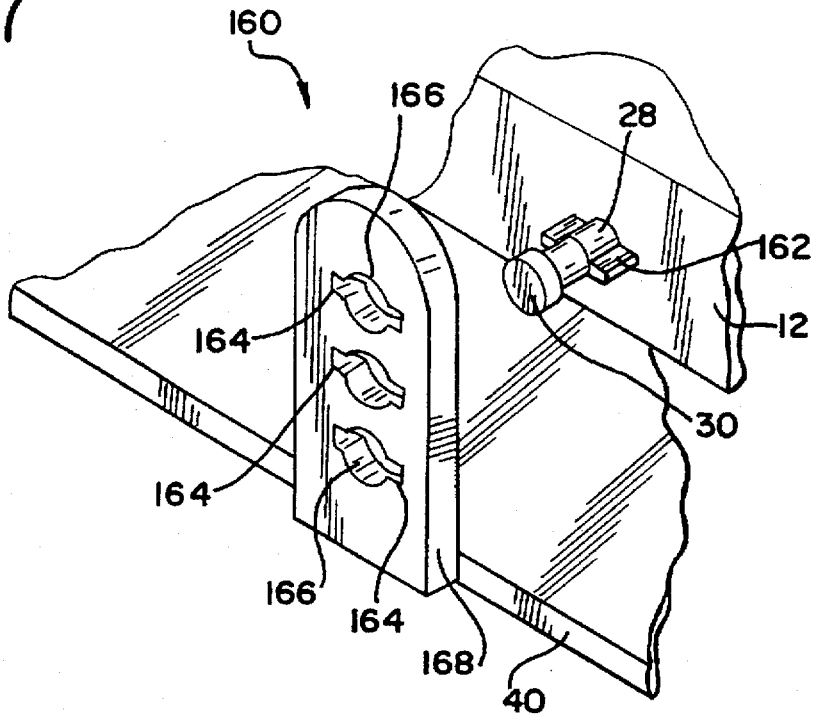
FIG. 7 is a fragmentary exploded perspective elevation of an alternate foot plate height adjustment to the embodiment of FIG. 2.

Referring now to FIG. 7, another alternate embodiment of the present fin 10 is generally designated 160. The embodiment 160 is identical to the embodiment 10 with the exception of the vertical adjustment of the foot plate 40 relative to the blade portion 12. In the embodiment 160, each stub shaft 28 has at least one radially projecting lug 162, and in the pictured embodiment a pair of diametrically opposed lugs are provided. A corresponding locking slot 164 is also provided in communication with each opening 166 in the bracket 168 for receiving the corresponding lug when the stub shaft engages the opening. The bracket 168 differs from the bracket 44 in that the openings 166 are not connected to each other by channels 54, and as described above, include radially projecting locking slots 164. Preferably, one bracket 168 is located on each side of the foot plate 40.

In the fin 160, when the diver wishes to adjust the vertical relationship between the blade portion 12 and the foot plate 40, the heel strap buckles 78 are first detached from the stub shaft 28. The stub shafts 28 are then withdrawn from the brackets 168, and thus the openings 166 are dimensioned to accept the knobbed ends 30. It is preferred that the blade portion 12 be manufactured of a flexible enough material so that when the user desires to vertically adjust the relationship between the foot plate 40 and the blade portion 12, the shoe end may be squeezed or otherwise manipulated to easily withdraw the stub shafts 28 from the openings 166. The stub shafts 28 are then reinserted to the appropriate opening 166, and the tight frictional engagement between the lugs 162 and the locking slots 164 maintain the proper engagement, which is further maintained by the replacement of the buckles 78. Thus the embodiment 160 differs from the vertical adjustment system described in relation to FIGS. 1–4 in its lack of a cammed adjustor disk 56 and the communicating elliptical adjustment openings 46. Instead, locking vertical adjustment of the foot plate to the blade portion 12 is achieved through the engagement of the lugs 162 in the slots 164.

Figure 8:
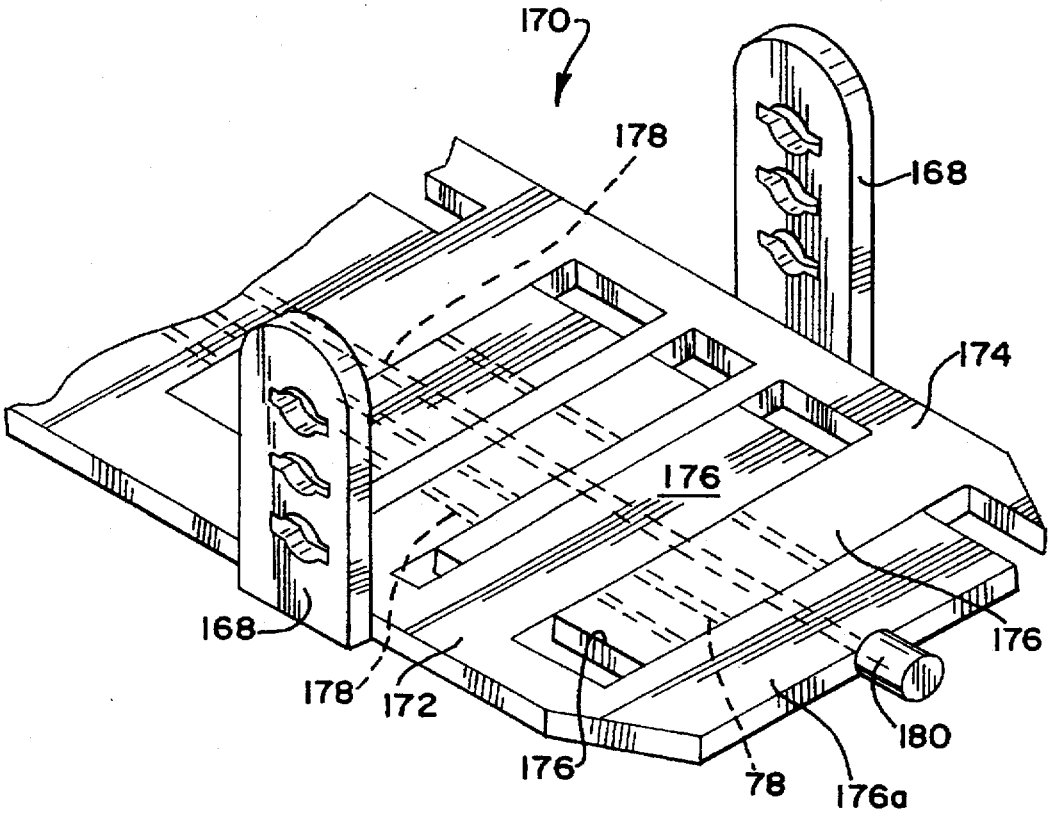
FIG. 8 is a fragmentary perspective elevational view of an alternate embodiment of the foot plate shown in FIG. 1, having a width adjustment.

Referring now to FIG. 8, an alternate embodiment of the foot plate 40 is generally designated 170. A major feature of this foot plate 170 is that it is laterally adjustable to accommodate dive boots or shoes of varying widths. This is accomplished by providing the foot plate 170 in two portions, designated 172 and 174. Each portion 172, 174 is provided with a series of spaced, generally parallel, laterally projecting teeth 176. The teeth 176 are arranged so that the teeth of each portion 172, 174 are spaced to engage spaces between corresponding teeth of the opposing portion. At least one of the portions 172, 174 is provided with at least one throughbore 178 (shown hidden) extending along an axis parallel with the longitudinal axis of the foot plate 170. The other of the portions 172, 174 is also provided with at least one such throughbore 178, so that a rod 180 passing through a first tooth 176*a* of the portion 172 will engage a desired one of the throughbores 178 of the portion 174. Once the rod 180 is withdrawn, the portions 172, 174 may be laterally adjusted relative to each other, and the throughbores of the respective portions placed in registry with each other at the desired relative width. The rod 180 is then reinserted into the throughbores 178 at the newly selected width. It is contemplated that the number, size and spacing of teeth 176, the number, size and placement of throughbores 178 and the number, size and placement of rods 180 may vary to suit the application. Although the foot plate 170 is shown with brackets 168, it is also contemplated that brackets 44 may also be employed.

Figure 9:
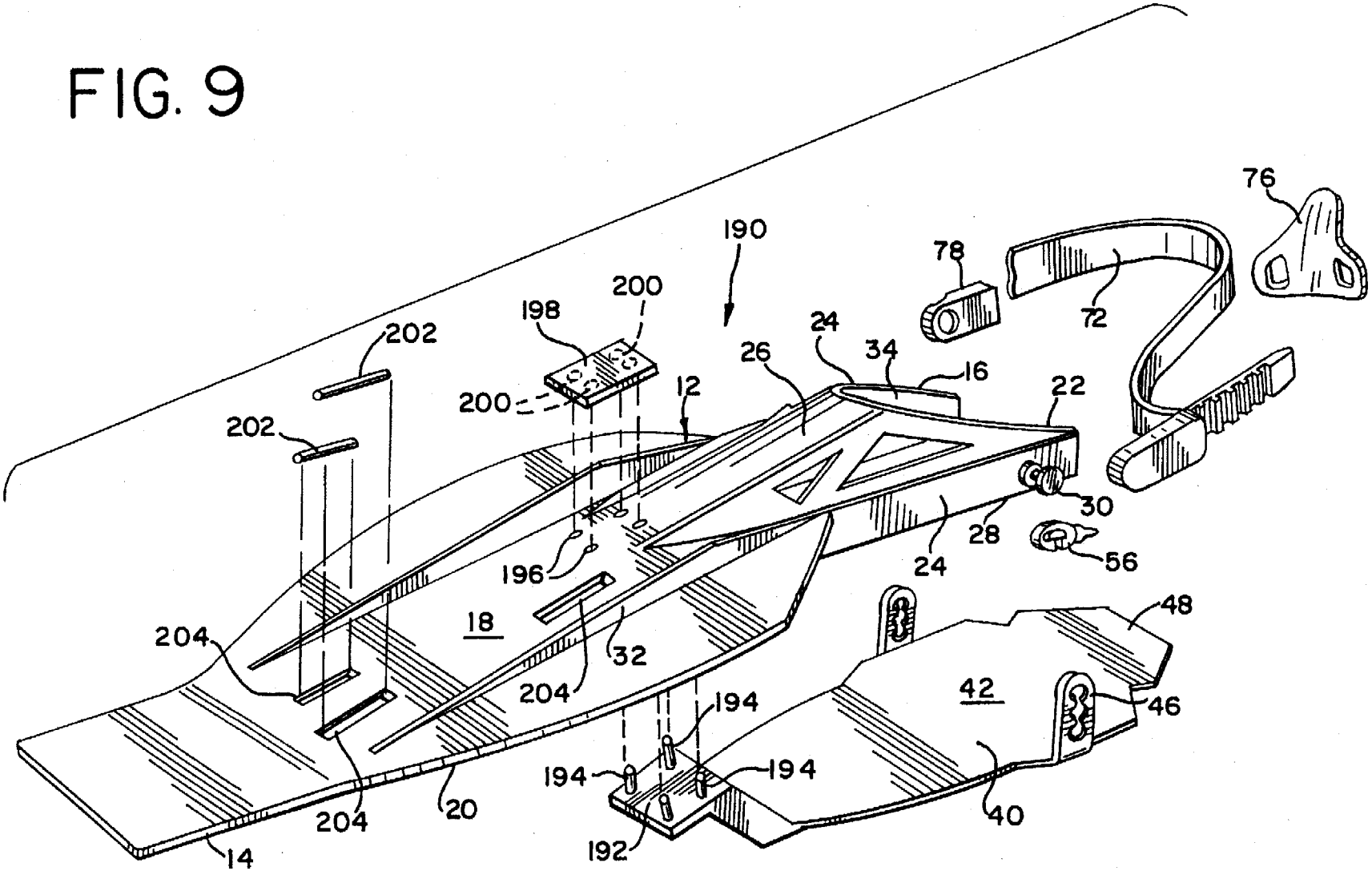
FIG. 9 is an exploded perspective elevation of a fin incorporating a third alternate embodiment of the present invention.

Referring now to FIG. 9, another alternate embodiment of the fin 10 is generally designated 190. The fin 190 incorporates many of the features of the fin 10, which are designated with identical reference numerals. The most distinctive feature of the fin 190 is that the front end 50 of the foot plate 40 is provided with a tab 192 having at least one first fastener portion, such as a lug 194. Preferably a plurality of such fastener portions are provided. The lug is constructed and arranged to pass through a corresponding opening 196 in the blade portion 12 and be matingly engaged by a retainer plate 198 having a corresponding second fastener portion, such as a recess 200 (shown hidden). In the preferred embodiment, the number and arrangement of the first and second fastener portions 194, 200 may vary to suit the application. For example, the lugs 194 may also be located on the retainer plate 198, and the recesses 200 may be located on the tab 192. In this manner, the front end 50 of the foot plate 40 is attached to the blade portion 12 through the abutment and fastening of the tab 192 to the underside 20 of the blade portion.

Another feature of the fin 190 is that it is provided with at least one separate stiffness adjusting insert 202 configured to be retained in a corresponding stiffness recess 204 formed in the surface of the blade portion 12, on either or both of the top surface 18 or the underside 20. In the preferred embodiment, the insert 202 is generally rod-shaped, and is made of a material which is stiffer than the material forming the blade portion 12. However it is contemplated that the number, stiffness, and shape of the stiffness inserts 202 may vary to suit the particular application. The retention of the insert 202 in the recess may be by friction fit, chemical adhesive or conventional fasteners. The more inserts 202 placed on a blade portion 12, the stiffer the blade will become.

Accordingly, it will be seen that the various embodiments of the present fin 10, 90, 120, 160 and 190 all provide a two piece construction which allows a degree of adjustability of the size of the foot pocket. At the same time, various types of blade configurations may be provided by the manufacturer to fit a specific foot pocket without incurring substantial tooling or manufacturing costs. Also, a single style and size configuration of fin will fit a wider variety of diver shoe sizes than previously available fins.

While a particular embodiment of the multi-part diving fin of the invention has been shown and described, it will be appreciated by those skilled in the art that changes and modifications may be made thereto without departing from the invention in its broader aspects and as set forth in the following claims.

What is claimed is:

1. A multi-part diving fin, comprising:

a blade portion having a tip and a shoe end opposite said tip, said shoe end at least partially defining a foot pocket;

a foot plate formed as a separate piece from said blade portion and having a formation for engaging said blade portion, said foot plate configured so that upon engagement with said blade portion, said foot plate provides at least a portion of a bottom of said foot pocket;

said blade portion has a slot and said foot plate has a first end having a tab constructed and arranged to engage said slot; and said foot plate is pivotable in a vertical plane parallel to the longitudinal axis of said blade portion, said tab defining the pivot point.

2. The diving fin as defined in claim 1, wherein said foot plate is provided with a first end for engaging said blade portion and a second end being adjacent said shoe end.

3. The diving fin as defined in claim 1 wherein said foot plate includes at least one blade stiffening formation configured for engagement with corresponding formations on said blade portion.

4. The diving fin as defined in claim 3 wherein said at least one blade stiffening formation is scored into segments to provide varying degrees of stiffness depending on the number of segments used.

5. The diving fin as defined in claim 1 wherein said tip is provided with at least one detachable segment for adjusting the amount of water displaced by the fin and the corresponding work required by the diver to move the blade through the water.

6. The diving fin as defined in claim 1 wherein said foot plate is vertically adjustable relative to said blade portion.

7. The diving fin as defined in claim 6 wherein said shoe end has a laterally projecting stub shaft on each side for receiving buckled ends of a heel strap, said foot plate is provided with a bracket vertically projecting from opposite sides of said foot plate, and each said bracket has at least two vertically spaced openings for engaging said corresponding stub shaft.

8. The diving fin as defined in claim 7 further including at least one radially projecting lug on each stub shaft, and a corresponding locking slot in each said opening in communication with said opening for lockingly receiving said corresponding lug when said stub shaft engages said opening.

9. The diving fin as defined in claim 7 wherein said foot plate is provided with an adjustor disc configured to be rotatable about said stub shaft and having a cam located on a first side of said disc, and said openings on said bracket are connected by a relatively narrower open channel, said cam being dimensioned to engage a selected one of said openings in a first position, wherein vertical adjustment of said foot plate relative to said blade portion is achieved by rotation of said cam about said shaft to a second position which enables said cam to slide in said channel to a second one of said openings, said whereby said disc is then rotated to said first position to lock said cam in said second opening.

10. The fin as defined in claim 7 further including a heel strap having first and second ends, and a buckle disposed at each of said ends, each said buckle configured to releasably engage a corresponding one of said stub shafts.

11. The fin as defined in claim 1 wherein at least one of said foot plate and said blade portion are made of a material having a specific gravity of at least 1.0.

12. The fin as defined in claim 1 wherein at least one of said foot plate and said blade portion are made of a material having a 24 hour water absorption in the approximate range of 0.15 to 3.5 $in^3/lb$.

13. The fin as defined in claim 1 wherein at least one of said foot plate and said blade portion are made of a material having a flexural modulus in the approximate range of 100 to 500 ($10^3$ p.s.i).

14. The fin as defined in claim 1 wherein at least one of said foot plate and said blade portion are made of a material having a tensile yield in the approximate range of 1,000 to 15,000 ($10^3$ p.s.i.).

15. The fin as defined in claim 1 wherein at least one of said foot plate and said blade portion are made of a material having a specific gravity of at least 1.0, a 24 hour water absorption in the approximate range of 0.15 to 3.5 $in^3/lb.$, a flexural modulus in the approximate range of 100 to 500 ($10^3$ p.s.i.), and a tensile yield in the approximate range of 1,000 to 15,000 ($10^3$ p.s.i.).

16. The fin as defined in claim 1 whereby between approximately 10 to 100% of said blade portion is provided with a bonded graphics treatment.

17. The fin as defined in claim 16 wherein said bonded graphics treatment is selected from the group consisting of sublimation, printing, etching and painting.

18. The fin as defined in claim 1 wherein said foot plate is laterally adjustable to accommodate shoes of varying widths.

19. The fin as defined in claim 1 wherein said blade portion is provided with at least one skeg configured to be attachable to at least one location on said blade.

20. A swimming fin comprising:

a blade portion and a separate foot plate, the blade portion having a longitudinal axis, two side edges and a knobbed stub shaft projecting from each side generally normally to said axis;

a bracket projecting from at least one side of said foot plate and having at least two vertically spaced openings, said openings being constructed and arranged on said foot plate so that vertical adjustment of said foot plate relative to said blade portion is achieved by insertion of said stub shaft into a corresponding one of said openings.

21. The apparatus as defined in claim 20 further including an adjustor disc configured to be rotatable about said stub shaft and having a cam located on a first side of said disc, said openings on said bracket are connected by a relatively narrower open channel, said cam being dimensioned to engage a selected one of said openings in a first position, wherein vertical adjustment of said foot plate relative to said blade portion is achieved by rotation of said cam about said shaft to a second position which enables said cam to slide in said channel to a second one of said openings, said whereby said disc is then rotated to said first position to lock said cam in said second opening.

22. The height adjusting apparatus as defined in claim 21 further including a finger tab on said adjustor disc for facilitating the rotation of said disc about said shaft.

23. A stiffness adjustment for a diving fin having a blade portion with a tip and a shoe end opposite the tip, said blade portion having a longitudinal axis, and a foot plate separate from said blade portion, said stiffness adjustment comprising:

at least one stiffness rod located on said foot plate so as to engage a corresponding tube on said blade portion, the stiffness of said blade portion increasing with the distance of penetration of said rods in said tube.

24. The stiffness adjustment as defined in claim 23 wherein each said stiffness rod is scored for measured length reduction and corresponding increase in blade portion flexibility.

25. The stiffness adjustment as defined in claim 23 wherein a pair of said stiffness rods are located at a front end of said foot plate, and also provide the attachment point of said front end to said blade portion.

26. A diving fin, comprising:

a blade portion having a tip, an upper surface, a lower surface, at least one open topped stiffness recess on said upper surface, and at least one stiffness adjusting insert configured to be secured in a corresponding one of said recesses, said recess configured to receive said stiffener in a direction normal to said upper surface.

27. A multi-part diving fin, comprising:

a blade portion having a tip and a shoe end opposite said tip, said shoe end at least partially defining a foot pocket;

a foot plate formed as a separate piece from said blade portion and having a formation for engaging said blade portion, said foot plate configured so that upon engagement with said blade portion, said foot plate provides at least a portion of a bottom of said foot pocket;

said foot plate includes at least one blade stiffening formation configured for engagement with corresponding formations on said blade portion.

28. A multi-part diving fin, comprising:

a blade portion having a tip and a shoe end opposite said tip, said shoe end at least partially defining a foot pocket;

a foot plate formed as a separate piece from said blade portion and having a formation for engaging said blade portion, said foot plate configured so that upon engagement with said blade portion, said foot plate provides at least a portion of a bottom of said foot pocket;

said foot plate is provided with a first end for engaging said blade portion and a second end being adjacent said shoe end;

said first end of said foot plate has at least one mounting formation for attachment to said blade portion, said at least one mounting formation is a tab configured for abutting an underside of said blade portion, and further including a retainer plate configured for being fastened to said tab through at least one corresponding opening in said blade portion.

29. A multi-part diving fin, comprising:

a blade portion having a tip and a shoe end opposite said tip, said shoe end at least partially defining a foot pocket; and a foot plate formed as a separate piece from said blade portion and having a formation for engaging said blade portion;

said foot plate includes an upper shell half and a lower shell half hinged together at a front end of each half to form said bottom of said foot pocket, said upper shell half configured for alignment with and attachment to an underside of said shoe end.

30. The diving fin as defined in claim 29 wherein said upper shell half has at least one mounting aperture, said shoe end has at least one corresponding aperture, and further including a snap fastener for engaging each of said fasteners for securing said foot plate to said shoe end.

* * * * *